United States Patent [19]

Walker

[11] Patent Number: 4,578,206

[45] Date of Patent: Mar. 25, 1986

[54] DETERGENT BLEACH COMPOSITIONS

[75] Inventor: Adrian W. Walker, Irby, Great Britain

[73] Assignee: Lever Brothers Company, New York, N.Y.

[21] Appl. No.: 619,975

[22] Filed: Jun. 13, 1984

[30] Foreign Application Priority Data

Jun. 20, 1983 [GB] United Kingdom ..... 8316761

[51] Int. Cl.[4] ..... C11D 7/54; C11D 3/395; D06L 3/02

[52] U.S. Cl. ..... 252/95; 252/99; 252/102; 252/133; 252/174.14; 252/186.43; 252/186.38

[58] Field of Search ..... 252/95, 102, 133, 174.14, 252/186.38, 99, 186.43

[56] References Cited

U.S. PATENT DOCUMENTS

| | | | |
|---|---|---|---|
| 3,156,654 | 11/1964 | Konecny et al. | 252/186.33 |
| 3,332,882 | 7/1967 | Blumbergs et al. | 252/95 |
| 3,372,125 | 3/1968 | Hill et al. | 252/99 |
| 3,398,096 | 8/1968 | Das et al. | 252/95 |
| 3,532,634 | 10/1970 | Woods | 252/186.4 |
| 4,128,494 | 12/1978 | Schirmann et al. | 252/99 |
| 4,208,295 | 6/1980 | Sai et al. | 252/94 |
| 4,481,129 | 11/1984 | Oakes | 252/99 |

FOREIGN PATENT DOCUMENTS

| | | |
|---|---|---|
| 82563 | 6/1983 | European Pat. Off. . |
| 141844 | 5/1980 | German Democratic Rep. . |

*Primary Examiner*—Lorenzo B. Hayes
*Assistant Examiner*—John F. McNally
*Attorney, Agent, or Firm*—Milton L. Honig; James J. Farrell

[57] ABSTRACT

Built detergent bleach compositions comprising a surface active agent, a peroxide compound/peracid precursor bleach system which forms peracids in solution, an alkali metal carbonate builder and trace levels of manganese (II) ions.

The detergent bleach compositions deliver an improved bleach performance and can be used for washing/cleaning of fabrics at temperatures of below 40° C.

5 Claims, No Drawings

DETERGENT BLEACH COMPOSITIONS

This invention relates to detergent bleach compositions which are particularly, but not essentially, adapted for fabric washing, and more particularly to built detergent compositions including a bleach system.

It is known to incorporate peracid bleach systems in the form of a peroxide compound such as sodium perborate together with peracid bleach precursors i.e. an organic compound which in solution react with the sodium perborate or any hydrogen peroxide adduct forming peracids, in detergent compositions. Such detergent compositions conventionally include, in addition to a detergent active material, a phosphate detergency builder such as sodium triphosphate.

Though peracid bleach systems comprising a combination of a peroxide compound such as sodium perborate, and a peracid precursor which form peracid in situ, are more effective at lower temperatures e.g. 50°–60° C. than the peroxide compounds per se, they do not exhibit adequate bleaching at temperatures below 40° C.

With the increasing trend of saving energy, housewives are becoming more and more energy-conscious and have gradually changed their washing habit towards lower wash-temperatures. Today a major proportion of housewives are washing also their white laundry using the 60° C. wash-cycle. A considerable saving of energy would be obtained if washing habits could be further shifted towards cooler and cold water washing e.g. below 40° C., also for whites. There is therefore a continuous desire from the part of investigators to find alternative and possibly simpler and cheaper ways of further activating peroxide/peracid precursor bleaching systems so as to improve the bleaching action of said systems.

U.S. Pat. No. 3,532,634 teaches the use of transition metals which must be used with special types of chelating agents to activate persalt/peracid precursor bleach systems.

There are several drawbacks of this teaching; firstly not all transition metals as proposal in the U.S. Patent are consistently effective in catalysing the bleaching action of the persalt/peracid precursor bleaching system; secondly the rather elaborate selection of the proper chelating agent not commonly used in detergent composition to fit with the specific metal used would incur not only extra cost, but also could limit the actual commercial exploitation of such compositions. As a matter of fact Applicant's own experiments have shown that in applying the technology of this art, most of the transition metals disclosed therin are ineffective or even detrimental at catalysing the bleaching action of persalt/precursor systems at the lower temperature region of below 40° C.

It has now surprisingly been found that the bleaching performance of peroxyacid bleach systems comprising a persalt and a peroxy acid precursor can be improved so as to be usable at temperatures of below 40° C., if manganese is used as the transition metal in conjunction with a carbonate builder. This is quite surprising since the use of special chelating agents as taught by U.S. Pat. No. 3,532,643 appears to be unnecessary and of all the transition metals mentioned therein only manganese is effective. Other metals of the transition series having atomic number of from 24 to 29 i.e Chromium, Iron, Cobalt, Nickel and Copper are ineffective or even cause a reduction in the bleaching effect. Only manganese exerts a catalysing effect on the peroxide compound/peracid precursor bleach system in the composition.

Thus, according to the invention there is provided a built detergent bleach composition comprising an alkalimetal carbonate builder, a peroxide compound bleach, a peracid precursor and trace levels of manganese (II) ions.

In terms of economy and simplicity the invention provides a substantial improvement over the U.S. Pat. No. 3 532 634 teaching in that all drawbacks of the proposed system of the art have been removed.

In some circumstances it is thought that the use of phosphates in detergent compositions can lead to environmental problems in waste waters. There is therefore a desire to reduce the level of phosphorus in detergent composition. Since carbonates, especially sodium carbonate have been suggested as alternative builders to phosphate, the present invention has the further advantage in that it uses less or no phosphate builder.

The ratio of peroxide compound to peracid precursor in the composition of the invention is not critical and can be varied widely from e.g. 1:1 to about 35:1. In addition thereto other sequestrant or non-sequestrant builders such as sodium triphosphate may be incorporated as desired in minor proportions to the carbonate builder e.g. up to 15% by weight of the composition.

In practice the composition of the invention will comprise from about 5 to 80% by weight preferably 10–60% by weight of the alkalimetal carbonate builder, preferably sodium carbonate, from 5 to about 50% by weight, preferably 5 to 35% by weight of the peroxide compound bleach, from about 0.1 to 25% by weight, preferably from 0.1 to 15% by weight of a peracid precursor, and from about 0.005 to 0.1% by weight of Manganese (II).

As already explained above the gist of the invention is that trace levels of manganese (II) ions is used in conjunction with a carbonate builder. Optimum effects are achieved if the manganese (II) ion concentration in the wash/bleach solution is within the range of from about 0.1 to 1 parts per million.

The Manganese (II) ions added for improving the bleach performance according to the invention can be derived from any water-soluble Manganese (II) salts or complexes, such as manganous sulphate or manganous chloride, or from any manganese compound in whatever form which delivers manganese (II) ions in aqueous solution. Protection of the manganese (II) compound against contact with the bleaching agent may be necessary to avoid premature reaction prior to its point of use.

The detergent composition of the invention usually contains a surface active agent generally in an amount of from about 2 to about 50% by weight, preferably form 5–30% by weight. The surface active agent can be anionic, nonionic, zwitterionic or cationic in nature or mixtures thereof.

Preferred anionic non-soap surfactants are water soluble salts of alkylbenzene sulphonate, alkyl sulphate, alkylpolyethoxyether sulphate, paraffin sulphonate, alphaolefin sulphonate, alpha-sulfocarboxylates and their esters, alkylglycerylethersulphonate, fatty acid monoglyceride-sulphates and -sulphonates, alkylphenolpolyethoxy ethersulphate, 2-acyloxy-alkane-1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$—groups per molecule, especially about 10 to about 16 carbon atoms in the alkyl chain and an average of about 1 to about 6 —$CH_2CH_2O$— groups per molecule; linear paraffin sulphonates with about 8 to about 24 carbon atoms, more especially from about 14 to about 18 carbon atoms and alpha-olefin sulphonates with about 10 to about 24 carbons atoms, more especial-ly about 14 to about 16 carbon atoms; and soaps having from 8 to 24, especially 12 to 18 carbon atoms.

Water-solubility can be achieved by using alkali metal, ammonium, or alkanolamine cations; sodium is preferred.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of poly-ethoxy alcohol are commercially available under the trade-names of "Neodol"®, "Synperonic"® and "Tergitol"®, which are registered Trade Marks.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethyl-propanesulphonates and alkyldimethyl-ammoniohydroxy-propane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

Typical examples of suitable peroxide compound bleaches are alkalimetal perborates, both tetrahydrates and monohydrates, alkali metal percarbonates, persilicates and perphosphates, of which sodium perborate is preferred.

Peracid bleach precursors, also called activators, have been amply described in the literature, including British Pat. Nos. 836,988, 855,735, 907,356, 907,358, 970,950, 1,003,310, 1,246,339, U.S. Pat. Nos. 3,332,882 and 4,128,494, Canadian Pat. No. 844,481 and South African Pat. No. 68/6,344. Specific suitable activators include:

(a) N-diacylated and N,N'-polyacylated amines, such as N,N,N',N'-tetraacetyl methylene diamine and N,N,N',N'-tetraacetyl ethylene diamine, N,N-diacetylaniline, N,N-diacetyl-p-toluidine; 1,3-diacylated hydantoins such as, for example, 1,3-diacetyl-5,5-dimethyl hydantoin and 1,3-dipropionyl hydantoin; -acetoxy-(NN,N')-polyacylmalonamide, for example -acetoxy-(N,N')-diacetylmalonamide;

(b) N-alkyl-N-sulphonyl carbonamides, for example the compounds N-methyl-N-mesyl-acetamide, N-methyl-N-mesylbenzamide, N-methyl-N-mesyl-p-nitrobenzamide, and N-methyl-N-mesyl-p-methoxybenzamide;

(c) N-acylated cyclic hydrazides, acylated triazones or urazoles, for example monoacetylmaleic acid hydrazide;

(d) O,N,N-trisubstituted hydroxylamines, such as O-benzoyl-N,N-succinyl hydroxylamine, O-acetyl-N,N-succinyl hydroxylamine, O-p-methoxybenzoyl-N,N-succinylhydroxylamine, O-p-nitrobenzoyl-N,N-succinylhydroxylamine and O,N,N-triacetyl hydroxylamine;

(e) N,N'-diacyl-sulphurylamides, for example N,N'-dimethyl-N,N'-diacetyl-sulphurylamide and N,N'-diethyl-N,N'-dipropionyl sulphurylamide;

(f) Triacylcyanurates, for example triacetyl cyanurate and tribenzoyl cyanurate;

(g) Carboxylic acid anhydrides, such as benzoic anhydride, m-chloro-benzoic anhydride, phthalic anydride, 4-chloro phthalic anhydride;

(h) Esters, for example glycose pentaacetate, xylose tetra acetate, sodium acetoxy benzene sulphonate and sodium benzoyloxy benzensulphonate;

(i) 1,3-diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy-imidazoline;

(j) Tetraacetylglycoluril and tetrapropionylglycoluril;

(k) Diacylated 2,5-diketopiperazine, such as 1,4-diacetyl-2,5-diketopiperazine, 1,4-dipropionyl-2,5-diketopiperazine and 1,4-dipropionyl-3,6-dimethyl-2,5-diketopiperazine;

(l) Acylation products of propylenendiurea or 2,2-dimethylpropylenediurea (2,4,6,8-tetraaza-bicyclo-(3,3,1)-nonane-3,7-dione or its 9,9-dimethyl derivative), especially the tetraacetyl- or the tetrapropionylpropylenediurea or their dimethyl derivatives;

(m) Carbonic acid esters, for example the sodium salts of p-(ethoxycarbonyloxy)-benzoic acid and p-(propoxycarbonyloxy)-benzenesulhonic acid.

(n) Acyloxy-(N,$N^1$)polyacyl malonamides, such as alpha-acetoxy(N,$N^1$)diacetyl malonamide.

The N-diacylated and N,N'-polyacylatedamines mentioned under (a) are of special interest, particularly N,N,N',N'-tetra-acetyl-ethylenediamine (TAED).

In addition thereto the compositions of the invention may contain any of the conventional components and/or adjuncts usable in fabric washing compositions.

As such can be named, for instance soil-suspending agents such as water-soluble salts of carboxymethylcellulose, carboxyhydroxymethylcellulose, copolymers of maleic hydride and vinyl ethers, and polyethylene glycols having a molecular weight of about 400 to 10.000. These can be used at levels of about 0.5% to about 10% by weight. Dyes, pigments, optical brighteners, perfumes, anti-caking agents, suds control agents, fabric softening agents, alkaline agents, fillers and ethylenediamine tetracetate can also be added in varying amounts as desired. Also stabilisers such as ethylene diamine tetra(methylenephosphonates) and diethylene triamine penta(methylene phosphonates) may be added as desired.

In the following Examples illustrating the invention manganous sulphate was used to deliver $Mn^{2+}$.

EXAMPLE I

The following base detergent powder composition was used in the experiments.

| Composition | parts by weight |
|---|---|
| $C_{14-15}$ fatty alcohol condensed with 13 ethylene oxide groups | 1.5 |
| Sodium coconut fatty acid soap | 1.0 |
| Sodium carbonate | 33.0 |
| Sodium silicate alkaline 1:2 | 7.6 |
| Sodium carboxymethyl cellulose | 0.33 |
| Fluorescer | 0.1 |
| Sodium sulphate | 44.0 |
| Water | 3.5. |

The above base detergent powder composition was dosed at 4 g/l in water and 0.2 g/l TAED and 0.45 g/l sodium perborate tetrahydrate was added. A series of solutions with and without added metal ions were used for washing/bleaching of tea stained test cloths in a one hour isothermal wash at 25° C.

The bleaching effects achieved on tea-stained test cloths measured as ΔR*460 (reflectance value) were as follows:

TABLE I

| Metal ion | ion concentration (ppm) | ΔR*460 (reflectance value) |
|---|---|---|
| None (control) | — | 3.3 |
| Cobalt (II) | 1.0 | −1.2 |
| Chromium | 1.0 | 3.1 |
| Copper (II) | 1.0 | −1.0 |
| Iron (III) | 1.0 | 3.0 |
| Nickel (II) | 1.0 | 2.8 |
| Manganese (II) | 1.0 | 7.6 |

The above results clearly show that without the use of special chelating agents, Manganese (II) is the only metal which improves the bleaching performance of perborate/TAED system in a carbonate built detergent composition at 25° C.

All other metals of the above series were ineffective and Cobalt and Copper were even detrimental to the bleaching performance.

EXAMPLE II

The following carbonate built detergent bleach powder composition was used in the experiments.

| Composition | Parts by weight |
|---|---|
| $C_{14-15}$ fatty alcohol condensed with 13 ethylene oxide groups | 1.5 |
| Sodium coconut fatty acid soap | 1.0 |
| Sodium carbonate | 33.0 |
| Sodium silicate alkaline 1:2 | 7.6 |
| Sodium carboxymethyl cellulose | 0.33 |
| Fluorescer | 0.1 |
| Sodium sulphate | 44.0 |
| Water | 3.5 |
| Post dosed: | |
| TAED | 2.0% |
| Sodium perborate tetrahydrate | 25.0% |

The above detergent bleach composition was dosed at 4 g/l in water and solutions with or without manganese or manganese/picolinic acid were used for washing and bleaching of tea-stained test clothes in a one hour isothermal wash test at 30° C. and at PH 10.35.

The bleaching effects measured as ΔR*460 (reflectance value) were as follows:

| Solution | ΔR*460 |
|---|---|
| Without catalyst (control) | 4.3 |
| + $Mn^{2+}$ (1 ppm) | 9.6 |
| + $Mn^{2+}$ (1 ppm) + picolinic acid ($1.7 \times 10^{-4}$ M) | 8.7 |

The detrimental effect of picolinic acid on manganese catalysis of perborate/TAED bleach system is clearly demonstrated.

EXAMPLE III

The following detergent bleach powder compositions were prepared:

| Composition | Parts by weight A | Parts by weight B |
|---|---|---|
| $C_{14-15}$ fatty alcohol/13 ethylene oxide | 1.5 | 1.5 |
| Sodium coconut fatty acid soap | 1.0 | 1.0 |
| Sodium carbonate | 33.0 | 33.0 |
| Alkaline sodium silicate (1:2) | 7.6 | 7.6 |
| Sodium Carboxymethyl cellulose | 0.33 | 0.33 |
| Fluorescer | 0.1 | 0.1 |
| Sodium sulphate | 44.0 | 44.0 |
| Water | 3.5 | 3.5 |
| Post dosed: | | |
| TAED (peroxy acid precursor) | — | 1.0% |
| Sodium perborate tetrahydrate | 40.0% | 40.0% |

The compositions were used in a washing test at the same wash conditions as used in Example II.

The following results were obtained:

| Composition | ΔR*460 (reflectance value) |
|---|---|
| A | 1.3 |
| A + $Mn^{2+}$ (1 ppm in solution) | 7.0 |
| B | 2.2 |
| B + $Mn^{2+}$ (1 ppm in solution) | 11.4 |

The superior bleaching effect at 30° C. of composition B+manganese according to the invention in the absence of any special chelating agent, over the other compositions is evident.

I claim:

1. A carbonate built detergent bleach composition comprising:

(I) from about 2 to 50% by weight of a surface active agent, selected from the group consisting of anionic, nonionic, zwitterionic and cationic detergents, and mixtures thereof;

(II) from 5 to 80% by weight of an alkali metal carbonate builder;

(III) from 5 to 50% by weight of a peroxide compound bleach;

(IV) from 0.1 to 25% by weight of a peracid precursor which reacts with the peroxide compound in solution forming a peracid; and (V) from 0.005 to 0.1% by weight of manganese (II) ions.

2. A built detergent bleach composition, according to claim 1 wherein said peroxide compound bleach is sodium perborate.

3. A built detergent bleach composition, according to claim 1 wherein said peroxy acid precursor is N,N,N',N'-tetra acetyl ethylene diamine (TAED).

4. A built detergent bleach composition, according to claim 1 wherein said alkali metal carbonate builder is sodium carbonate.

5. A built detergent bleach composition according to claim 1, which further comprises other sequestrant or non-sequestrant builders in an amount of up to 15% by weight of the composition.

* * * * *